US009393574B1

(12) United States Patent
Morris

(10) Patent No.: US 9,393,574 B1
(45) Date of Patent: Jul. 19, 2016

(54) WEAR INSERT FOR THE SOLIDS DISCHARGE END OF A HORIZONTAL DECANTER CENTRIFUGE

(76) Inventor: Ray Morris, Magnolia, TX (US)

( * ) Notice: Subject to any disclaimer, the term of this patent is extended or adjusted under 35 U.S.C. 154(b) by 818 days.

(21) Appl. No.: 13/316,764

(22) Filed: Dec. 12, 2011

Related U.S. Application Data

(60) Provisional application No. 61/423,002, filed on Dec. 14, 2010.

(51) Int. Cl.
*B04B 7/12* (2006.01)
*B04B 1/20* (2006.01)

(52) U.S. Cl.
CPC ..... *B04B 1/2008* (2013.01); *B04B 7/12* (2013.01); *B04B 2001/2091* (2013.01)

(58) Field of Classification Search
CPC B04B 1/20; B04B 2001/2091; B04B 1/2008; B04B 7/12
USPC ..... 494/53, 54, 56; 210/380.1, 380.3
See application file for complete search history.

(56) References Cited

U.S. PATENT DOCUMENTS

| | | | | | |
|---|---|---|---|---|---|
| 3,764,062 | A | | 10/1973 | Brautigam | |
| 3,880,346 | A | * | 4/1975 | Hopfe | 494/53 |
| 4,416,656 | A | | 11/1983 | Shapiro | |
| 4,482,344 | A | | 11/1984 | Zettier | |
| 5,244,584 | A | * | 9/1993 | Schlieperskoetter | 210/787 |
| 5,259,828 | A | * | 11/1993 | Schlieperskoetter | 494/38 |
| 5,380,434 | A | * | 1/1995 | Paschedag | 210/360.2 |
| 5,584,791 | A | * | 12/1996 | Grimwood et al. | 494/54 |
| 5,618,409 | A | * | 4/1997 | Kreill | 210/97 |
| 6,241,901 | B1 | * | 6/2001 | Leung | 210/781 |
| 6,290,636 | B1 | * | 9/2001 | Hiller et al. | 494/53 |
| 6,390,965 | B1 | * | 5/2002 | Matsushima | 494/16 |
| 7,001,324 | B2 | * | 2/2006 | Hensley et al. | 494/53 |
| 7,022,061 | B2 | * | 4/2006 | Leung et al. | 494/56 |
| 7,077,799 | B2 | * | 7/2006 | Gorham et al. | 494/37 |
| 7,282,019 | B2 | * | 10/2007 | Lantz | 494/54 |
| 7,374,529 | B2 | * | 5/2008 | Hensley et al. | 494/53 |
| 7,614,995 | B2 | * | 11/2009 | Schulz et al. | 494/56 |
| 8,672,243 | B2 | * | 3/2014 | Turcic et al. | 239/589 |
| 2004/0072667 | A1 | * | 4/2004 | Leung et al. | 494/56 |
| 2004/0072668 | A1 | * | 4/2004 | Leung | 494/56 |
| 2004/0167005 | A1 | * | 8/2004 | Hensley et al. | 494/53 |
| 2005/0164861 | A1 | * | 7/2005 | Bruning et al. | 494/56 |
| 2005/0245381 | A1 | * | 11/2005 | Tettleton et al. | 494/53 |
| 2006/0166803 | A1 | * | 7/2006 | Schulz et al. | 494/56 |
| 2007/0254795 | A1 | * | 11/2007 | Hensley et al. | 494/53 |
| 2012/0245014 | A1 | * | 9/2012 | Jones et al. | 494/37 |
| 2014/0038806 | A1 | * | 2/2014 | Lendzian | B04B 1/20 494/56 |
| 2015/0217303 | A1 | * | 8/2015 | Bauer | B04B 1/2016 494/4 |

FOREIGN PATENT DOCUMENTS

| | | | | |
|---|---|---|---|---|
| DE | 3620912 | A1 * | 12/1987 | B04B 11/02 |
| WO | 03076078 | | 9/2003 | |

* cited by examiner

*Primary Examiner* — Charles Cooley

(57) ABSTRACT

A horizontal decanter centrifuge has a centrifuge bowl with a solids discharge opening, a sleeve having to an interior of the centrifuge bowl and an opposite end opening at an exterior of the centrifuge bowl, and a retainer affixed to the exterior of the centrifuge bowl. The retainer has the sleeve extending therethrough. The retainer serves to removably secure the sleeve in a fixed position with respect to the centrifuge bowl. The sleeve has an interior wall formed of a carbide material.

18 Claims, 3 Drawing Sheets

WEAR INSERT FOR THE SOLIDS DISCHARGE END OF A HORIZONTAL DECANTER CENTRIFUGE

RELATED U.S. APPLICATIONS

The present application claims priority from U.S. Provisional Patent Application No. 61/423,002, filed on Dec. 14, 2010, and entitled "Wear Insert for the Solids Discharge End of a Horizontal Decanter Centrifuge".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to horizontal decanter centrifuges. More particularly, the present invention relates to solids discharge ends for a horizontal decanter centrifuge. Even more particularly, the present invention relates to wear inserts for the solids discharge ends of a horizontal decanter centrifuge 2. Description of Related Art Including Information Disclosed Under 37 CFR 1.97 and 37 CFR 1.98

A decanting centrifuge is commonly used for separating solid matter from a solids-laden liquid. For example, drilling mud with solids entrained therein must be effectively cleaned so that the drilling mud can be recycled. For another example, many manufacturing and food processing systems use vast quantities of water. In such systems, the water picks up solid waste matter which must be removed from the water before it can be discharged, whether it is into the environment or into storage. Decanter centrifuges have proved to be effective and efficient in carrying out this function of removing the solids from the recyclable liquid.

Generally, a decanter centrifuge comprises a cylindrical or frustoconical bowl rotating in one direction and at a particular although variable speed, and a screw conveyor rotating in the same direction but at a different speed. The difference in the speeds of the bowl and the screw conveyor is commonly known in the art as the differential speed.

In a well known decanting centrifuge structure, liquid which is to be clarified enters an inlet to the centrifuge where it is brought up to rotational speed around the interior surface of the bowl. Heavier elements, i.e. solids, are brought to the interior surface of the bowl by centrifugal force (furthest from the axis of rotation), while lighter elements, i.e. water or drilling fluid, remains closer to the axis of rotation of the centrifuge. The screw conveyor, rotating at a speed slightly slower than that of the bowl, conveys the solids toward a beach in a conical portion of the bowl.

Various patents have issued in the past relating to decanter centrifuges and other centrifuges. For example, U.S. Pat. No. 7,114,360 issued on Dec. 5, 2006 to Zonneveld. The patent describes a centrifuge concentrator bowl having a plurality of fluidized recesses at axially spaced positions along the peripheral wall. Each recess is defined by two side walls which has water injection holes for fluidizing materials collecting in the recess. Some of the recesses are at least partly defined by a removable insert member arranged to be attached to a suitable mounting on the wall of the bowl. Each insert member includes a face portion defining a surface facing toward the axis of the bowl for engaging the slurry and preventing wear. The face portion may include a side portion on one side or both sides located radially inwardly of a rib on a respective side of the recess and at least partly covering the rib so as to prevent the slurry from contacting the rib and causing wear to the rib.

U.S. Pat. No. 7,001,324, issued on Feb. 21, 2006 to Hensley, describes a method of retrofitting a decanting centrifuge. The method includes disassembling a known centrifuge and replacing a bowl section of the centrifuge outer body with a longer bowl section. The method further comprises replacing the conical beach section with a shorter beach section, i.e. a beach section having a greater slope. The screw conveyor is replaced with another screw conveyor having outlet nozzles adapted to impart rotational movement to the inlet feed. The retrofitted centrifuge provides enhanced performance through an additional length of cylindrical section, thereby making the clarification length longer, and improving the effectiveness of the centrifuge in removing solids from the inlet feed. The retrofitted centrifuge preferably remains mounted to the same pedestal as the centrifuge prior to retrofit.

U.S. Pat. No. 4,482,344, issued on Nov. 13, 1984 to Zettier, describes a centrifuge drum for clarifying and separating liquids. The centrifuge consists of a bottom, a cover, and a closure ring that unites them. The liquid being centrifuged is conveyed through an inlet pipe to an inlet chamber. Bores extend from the inlet chamber down to a surface that demarcates the bottom of the drum. Each bore is provided with an insert in the form of a choking device that has an outlet channel Each outlet channel empties into a vestibule. The vestibules communicate with rising channels in a disk stack. The distributor and the bottom of the drum can be in one piece.

U.S. Pat. No. 4,416,656 issued on Nov. 22, 1983 to Shapiro, teaches a hard surfacing for a centrifuge conveyor. The centrifuge conveyor is provided with hard surfacing wherein assemblies of backing members and wear-resistant members are welded by the backing member to the conveyor. An assembly may be made unitary by providing a hole in either or both of the wear-resistant member and the backing member and securing them with means extending through the hole or holes. In the event that repair is necessary, an individual assembly may be replaced by welding technique, or the backing tile may be left in place and only the wear-resistant member replaced by removing and replacing the securing means. Each fragile wear-resistant member is braced against deflection at its outer portion through its backing member to the conveyor. The embodiments employ a plurality of wear-resistant members, each such member being accurately pressed from sintered tungsten carbide.

U.S. Pat. No. 3,764,062 issued on Oct. 9, 1973 to Brautigam, teaches a centrifuge apparatus. A helical screw conveyor of the centrifuge is provided with wear-resistant surfacing having a pre-formed backing tile of the same material as the conveyor, sub-assembled with a wear-resistant member and welded to the conveyor.

U.S. Pat. No. 5,244,584 issued on Sep. 14, 1993 to Schlieperskoetter, teaches a centrifuge with wear resistant openings. The method and apparatus is for the separation of a slurry into a light fraction and a heavier fraction with a rotatable drum separator having a rotatable worm therein driven independently of the drum with an inlet for the slurry into the drum, an outlet for a liquid fraction, and outlet openings adjacent one end of the drum such as in the conical portion for the removal of the heavier abrasive sludge fraction with the openings extending at an angle opposite the direction of rotation of the drum and having wear-resistant inserts in the opening attached to webs beside the openings and removable by being pivoted out through the openings.

International Publication WO 03/076078 published on Sep. 18, 2003, and describes a decanter centrifuge with a wear reinforcement inlet. The decanter centrifuge has a hollow, rotatable drum with a screw conveyor comprising a core body, in which an inlet opening for material into the drum from an inlet chamber is provided, the inlet opening having a delimitation surface which is rear relative to the direction of rotation and extending substantially axially, the delimitation surface being provided with a wear reinforcement member. The wear reinforcement member extends along the rear delimitation surface into the inlet chamber. The wear reinforcement member is provided with abutment surfaces in abutment against abutment surfaces associated with the core body, which during operation prevents the wear reinforcement member from moving tangentially forwards in the direction of rotation and radially out of the core body. At least one of said abutment surfaces associated with the core body is constituted by a removable blocking member. The wear reinforcement member and the inlet opening are designed in such a manner that the wear reinforcement member can be introduced to its operating from the exterior side of the core body.

It is an object of the present invention to provide a wear insert for the solids discharge end of a horizontal decanter centrifuge.

It is an object of the present invention to provide a wear insert for the solids discharge end of a horizontal decanter centrifuge that can be bolted in from the outside of the centrifuge.

It is another object of the present invention to provide a wear insert for the solids discharge end of a horizontal decanter centrifuge that is constructed of carbide.

It is another object of the present invention to provide a wear insert for the solids discharge end of a horizontal decanter centrifuge that is a direct bolt-on attachment for existing machines in the market.

It is another object of the present invention to provide a wear insert for the solids discharge end of a horizontal decanter centrifuge which prevents the escape of solids through unintended directions.

These and other objects and advantages of the present invention will become apparent from a reading of the attached specification and appended claims.

BRIEF SUMMARY OF THE INVENTION

The present invention is a wear insert for the solids discharge end of a horizontal decanter centrifuge. In particular, the present invention has a centrifuge bowl with a solids discharge opening, a sleeve having to an interior of the centrifuge bowl and an opposite end opening at an exterior of the centrifuge bowl, and a retainer affixed to the exterior of the centrifuge bowl. The retainer has the sleeve extending therethrough. The retainer secures the sleeve in a fixed position with respect to the centrifuge bowl.

In particular, the sleeve has an interior passageway with a wall extending therearound. The wall can be formed of a carbide material. Additionally, the sleeve can also be formed entirely of a carbide material. As such, wear resistance is effectively achieved.

In the preferred embodiment of the present invention, the opening of the centrifuge bowl has a diameter. The sleeve has a shoulder with a diameter greater than diameter of the opening of the centrifuge bowl. The shoulder has one side bearing against a surface adjacent the opening. The retainer has a tubular member extending therefrom. The tubular member has an end bearing against the shoulder of the sleeve. The sleeve extends through the tubular member of the retainer. The sleeve has an outer surface closely positioned against an inner wall of the tubular member. The opposite end of the sleeve is adjacent an exterior surface of the retainer.

Additionally, in the preferred embodiment of the present invention, the retainer is removably affixed to the centrifuge bowl so as to allow the sleeve to be removed from the centrifuge bowl. The retainer has a plurality of bolt holes formed therethrough. A plurality of bolts respectively extend through the plurality of bolt holes. The plurality of bolts are threadedly secured to the centrifuge bowl. In particular, the centrifuge bowl has a flat formed adjacent the solids discharge opening. The retainer has a planar surface juxtaposed against the flat. The flat of the centrifuge bowl has a plurality of threaded holes formed therein. The plurality of bolts each has a threaded end respectively secured in the plurality of threaded holes. The plurality of bolts each have a head bearing against a surface of the retainer.

Also, in the preferred embodiment of the present invention, the retainer has an opening formed therein. The sleeve extends through this opening. The opening has a lip extending inwardly therefrom. The opposite end of the sleeve bears against the lip.

It should be noted that under this section, the preferred embodiment of the present invention has been specifically recited. It should be recognized that various changes from the preferred embodiment of the present invention can be made within the scope of the claims. This section should not be considered as limiting of the scope of the present invention.

DETAILED DESCRIPTION OF THE INVENTION

Figure 1:
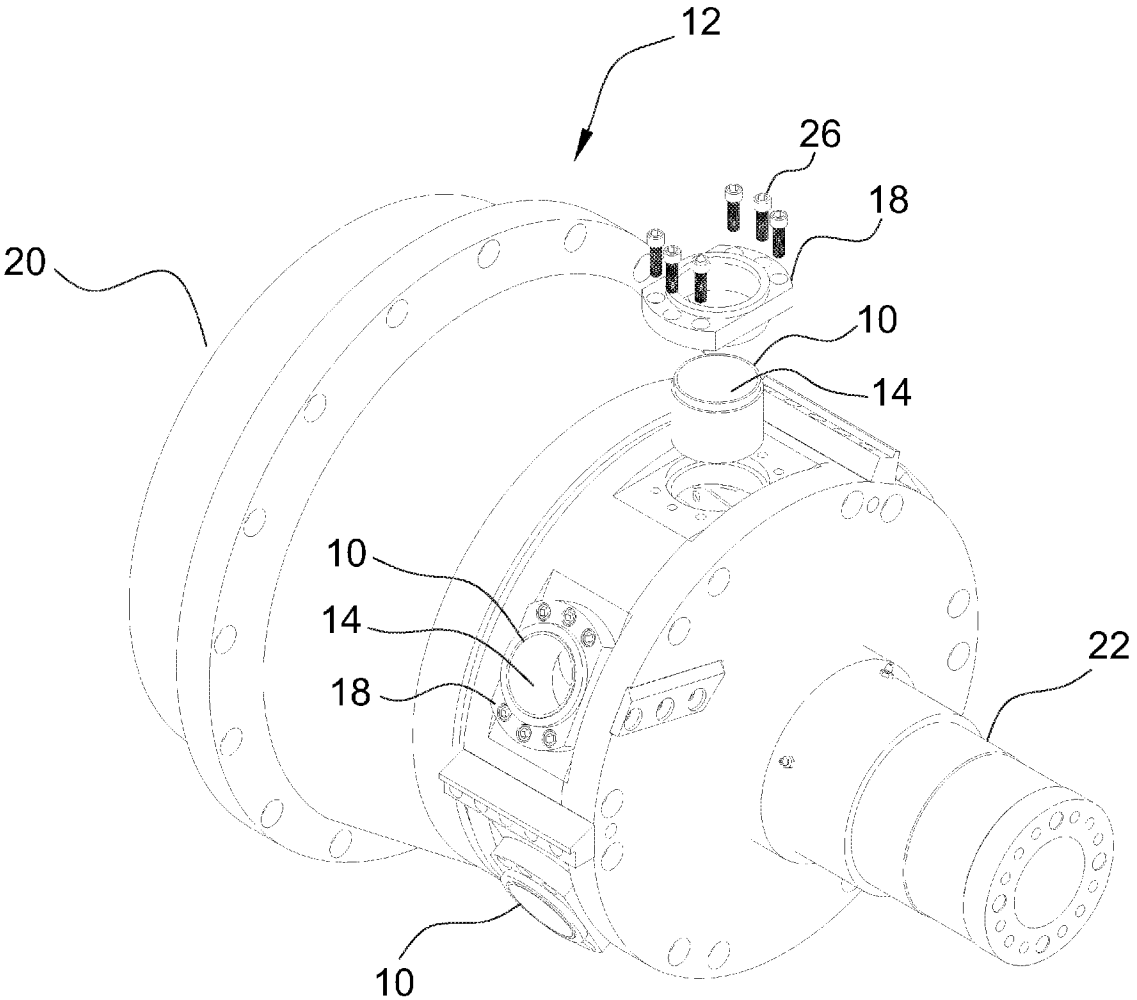
FIG. 1 is a perspective view showing the wear inserts of the present invention installed on the solids discharge end of a horizontal decanter centrifuge.

Referring to FIG. 1, the circular carbide wear inserts 10 are shown installed on the solids discharge end of a horizontal decanter centrifuge 12. The carbide wear inserts 10 are made of tungsten carbide and are bolted in from the outside of the bowl cylinder 20 of the horizontal decanter centrifuge 12. This allows the wear inserts 10 of the present invention to be field replaceable. The circular carbide wear insert 10 is held in place by a retainer 18 which is bolted in from the outside of the horizontal decanter centrifuge. The circular carbide wear insert 10 is a part that can be mounted to existing horizontal decanter centrifuges. Also shown in FIG. 1 is the main bearing and pulley 22 of the horizontal decanter centrifuge 12, carbide sleeve 14 and bolts 26.

Figure 2:
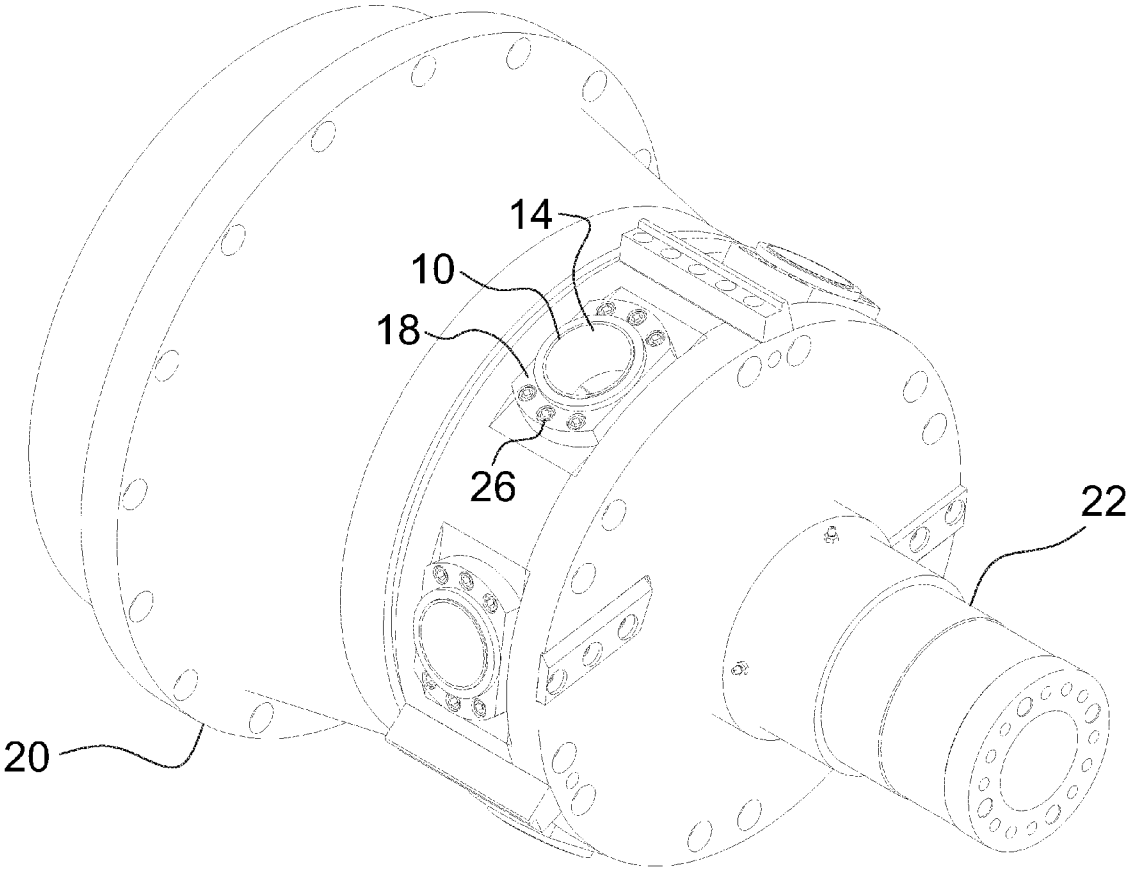
FIG. 2 is another perspective view showing the wear inserts of the present invention installed on the solids discharge end of a horizontal decanter centrifuge.

Referring to FIG. 2, a more detailed view of the circular carbide wear insert 10 is shown. In FIG. 2, it can be seen how the circular carbide wear insert 10 includes a carbide sleeve 14 which protrudes into the inside diameter of the centrifuge bowl 20 and extends thru the bowl wall to the outside of the centrifuge bowl 20. Solids are discharged thru this carbide sleeve 14. The sleeve 14 is installed from the outside of the bowl 20 making it readily replaceable in the field. The retainer 18 holds the sleeve 14 in place, and is secured by bolts 26. Also shown in FIG. 2 is pulley 22, and bolts 26.

Figure 3:
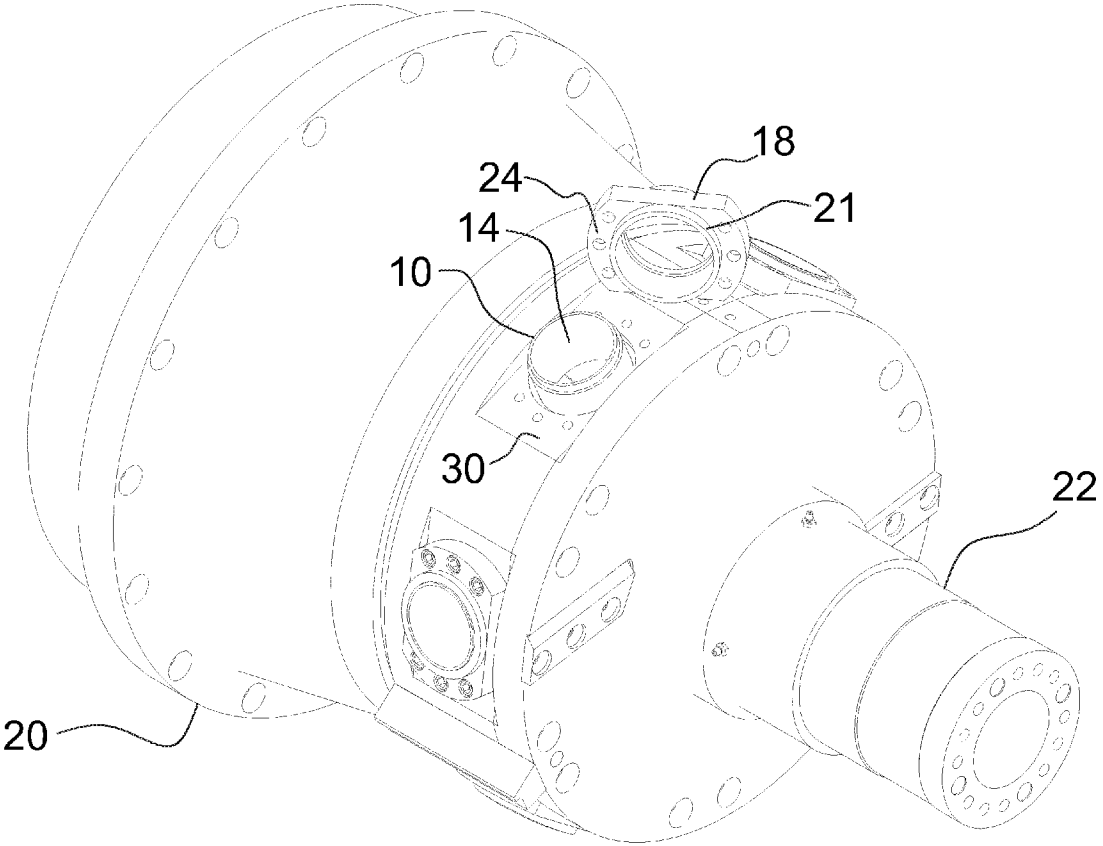
FIG. 3 is another perspective view showing the wear inserts of the present invention installed on the solids discharge end of a horizontal decanter centrifuge, wherein the retainer is unattached.

Referring to FIG. 3, the retainer 18 is shown in an unattached position. The sleeve 14 has a shoulder 21 around the outside diameter. The sleeve 14 is held in place when the retainer 18 slips over the outside diameter of the sleeve 14 and catches the aforementioned shoulder 21. The retainer 18 has a circular opening with a lip 24 for holding the carbide wear insert 10 in place. Also shown in FIG. 3 is pulley 22, centrifuge bowl 20, and flat 30.

Integral to the invention is a labyrinth created by the sleeve 14 and sleeve retainer 18 combination that prevents solids from escaping around the outside of the sleeve 14. In the manufacturing process, a hole is bored through to the inside diameter of the centrifuge bowl section 20 with minimal clearance for the carbide sleeve 14 to slip into. A small shoulder is left to prevent the sleeve from slipping into the bowl. Another larger bore is created for the retainer 18 approximately halfway up the length of the carbide sleeve 14. A flat 30 is milled on the outside diameter of the bowl 20 for the retainer 18 to seat flush against. This in effect creates the labyrinth that prevents solids from escaping around the outside. Solids would have to pass minimal clearance around the outer diameter of the sleeve 14, move laterally away from the sleeve bore to pass around the step in the retainer 18, pass minimal clearance around the outer diameter of the retainer 18, and again move laterally away from the sleeve 14 inner diameter on flat milled for retainer before escaping. This is vital because a critical flaw in existing wear protection methods allow solids to escape without passing around wear protection thereby voiding effectiveness of wear protection parts.

The wear insert of the present invention saves time and money because it can be readily installed externally in the field, as opposed to the inserts of the prior art which must be installed from the inside of the centrifuge. The tungsten carbide material also enables a long period of time between replacements.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. An apparatus comprising:

a centrifuge bowl having a solids discharge opening, the centrifuge bowl being generally rotationally symmetric about a bowl axis;

a sleeve having one end opening to an interior of said centrifuge bowl and an opposite end opening at an exterior of said centrifuge bowl; and a retainer affixed to said exterior of said centrifuge bowl, said retainer having said sleeve extending therethrough, said retainer securing said sleeve in a fixed position with respect to said centrifuge bowl by means of a plurality of bolts, and the bolts extending radially relative to the bowl axis, passing through the retainer and seated into the centrifuge bowl.

2. The apparatus of claim 1, said sleeve having an interior passageway with a wall extending therearound, said wall formed of a carbide material.

3. The apparatus of claim 1, said solids discharge opening of said centrifuge bowl having a diameter, said sleeve having a shoulder having a diameter greater than the diameter of said solids discharge opening of said centrifuge bowl, said shoulder having one side bearing against a surface adjacent to said solids discharge opening.

4. The apparatus of claim 3, said retainer having a tubular member extending therefrom, said tubular member having an end bearing against said shoulder of said sleeve.

5. The apparatus of claim 4, said sleeve extending through said tubular member of said retainer, said sleeve having an outer surface closely positioned against an inner wall of said tubular member.

6. The apparatus of claim 5, said sleeve having said opposite end adjacent an exterior surface of said retainer.

7. The apparatus of claim 1, said retainer being removably affixed to said centrifuge bowl via said bolts so as to allow said sleeve to be removed from said centrifuge bowl.

8. The apparatus of claim 7, said centrifuge bowl having a flat formed adjacent said solids discharge opening, said retainer having a planar surface juxtaposed against said flat.

9. The apparatus of claim 8, said flat of said centrifuge bowl having a plurality of threaded holes formed therein, said plurality of bolts each having a threaded end respectively secured in said plurality of threaded holes, said plurality of bolts each having a head bearing against the exterior surface of said retainer.

10. The apparatus of claim 1, said retainer having an opening formed therein, said sleeve extending through said retainer opening, said retainer opening having a lip extending inwardly therefrom, said opposite end of said sleeve bearing against said lip.

11. An apparatus comprising:

a centrifuge bowl having a solids discharge opening, the centrifuge bowl being generally rotationally symmetric about a bowl axis;

a sleeve having one end opening to an interior of said centrifuge bowl and an opposite end opening at an exterior of said centrifuge bowl; and a retainer affixed to said exterior of said centrifuge bowl, said retainer having said sleeve extending therethrough, said retainer securing said sleeve in a fixed position with respect to said centrifuge bowl by means of a plurality of bolts, the bolts extending radially relative to the bowl axis, passing through the retainer and seated into the centrifuge bowl, said solids discharge opening of said centrifuge bowl having a diameter, said sleeve having a shoulder having a diameter greater than diameter of said solids discharge opening of said centrifuge bowl, said shoulder having one side bearing against a surface adjacent said solids discharge opening, said retainer having a tubular member extending therefrom, said tubular member having an end bearing against said shoulder of said sleeve.

12. The apparatus of claim 11, said sleeve having an interior passageway with a wall extending therethrough, said wall formed of a carbide material.

13. The apparatus of claim 11, said sleeve extending through said tubular member of said retainer, said sleeve having an outer surface closely positioned against an inner wall of said tubular member.

14. The apparatus of claim 11, said retainer being removably affixed to said centrifuge bowl via said bolts so as to allow said sleeve to be removed from said centrifuge bowl.

15. The apparatus of claim 14, said centrifuge bowl having a flat formed adjacent said solids discharge opening, said retainer having a planar surface juxtaposed against said flat, said flat of said centrifuge bowl having a plurality of threaded holes formed therein, said plurality of bolts each having a threaded end respectively secured in said plurality of threaded holes, said plurality of bolts each having a head bearing against the exterior surface of said retainer.

16. The apparatus of claim 11, said retainer having an opening formed therein, said sleeve extending through said retainer opening, said retainer opening having a lip extending inwardly therefrom, said opposite end of said sleeve bearing against said lip.

17. An apparatus comprising:

a centrifuge bowl having a solids discharge opening, the centrifuge bowl being generally rotationally symmetric about a bowl axis;

a carbide sleeve having one end opening to an interior of said centrifuge bowl and an opposite end opening at an exterior of said centrifuge bowl; and a retainer removably affixed to said centrifuge bowl, said retainer having said carbide sleeve extending therethrough, said retainer securing said carbide sleeve in a fixed position with respect to said centrifuge bowl, said retainer having said carbide sleeve extending therethrough, said retainer securing said carbide sleeve in the fixed position with respect to said centrifuge bowl, said retainer being removably affixed by means of a plurality of bolts extending radially relative to the bowl axis, passing through the retainer and seated into said centrifuge bowl so as to allow said carbide sleeve to be removed from said centrifuge bowl.

18. The apparatus of claim 17, said solids discharge opening of said centrifuge bowl having a diameter, said carbide sleeve having a shoulder having a diameter greater than diameter of said solids discharge opening of said centrifuge bowl, said shoulder having one side bearing against a surface adjacent said solids discharge opening, said retainer having a tubular member extending therefrom, said tubular member having an end bearing against said shoulder of said carbide sleeve, said carbide sleeve extending through said tubular member of said retainer, said carbide sleeve having an outer surface closely positioned against an inner wall of said tubular member.

* * * * *